US012722932B2

(12) United States Patent
Sasaki et al.

(10) Patent No.: US 12,722,932 B2
(45) Date of Patent: Sep. 1, 2026

(54) WARP SUPPLY DEVICE FOR LOOM

(71) Applicant: TSUDAKOMA KOGYO KABUSHIKI KAISHA, Ishikawa-ken (JP)

(72) Inventors: Yuichi Sasaki, Ishikawa-ken (JP); Daisuke Yoshimori, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 254 days.

(21) Appl. No.: 18/373,009

(22) Filed: Sep. 26, 2023

(65) Prior Publication Data

US 2024/0117535 A1 Apr. 11, 2024

(30) Foreign Application Priority Data

Oct. 7, 2022 (JP) ..... 2022-162058

(51) Int. Cl.
*B65H 49/32* (2006.01)
*B65H 49/20* (2006.01)
(Continued)

(52) U.S. Cl.
CPC ..... *B65H 49/325* (2013.01); *B65H 49/20* (2013.01); *B65H 59/04* (2013.01); *D02H 1/00* (2013.01);
(Continued)

(58) Field of Classification Search
CPC .... B65H 49/26; B65H 49/324; B65H 49/325; B65H 59/04; B65H 49/32; B65H 59/046;
(Continued)

(56) References Cited

U.S. PATENT DOCUMENTS 1,302,803 A * 5/1919 Jenkins ..... B65H 59/04 242/422.4
1,340,710 A * 5/1920 Graham ..... G03B 21/321 242/423.2
(Continued)

FOREIGN PATENT DOCUMENTS

DE 69001283 T2 9/1993
DE 102005008705 B3 9/2006
(Continued)

OTHER PUBLICATIONS

Mar. 15, 2024, European Search Report issued for related EP Application No. 23200160.2.

*Primary Examiner* — Victoria P Augustine
*Assistant Examiner* — Katelynne R Burrell
(74) *Attorney, Agent, or Firm* — Paratus Law Group, PLLC

(57) ABSTRACT

A warp supply device for a loom includes reels on each of which a tape-shaped flat yarn as a warp yarn is wound in line, and a creel device in which the same number of the reels as the number of the warp yarn s to be used for weaving in the loom is mounted. The warp supply device includes: a plurality of support mechanisms provided to be attachable and detachable with respect to the creel device, the plurality of support mechanisms each supports a predetermined set number of the reels, the predetermined set number is two or more. Each of the plurality of support mechanisms includes: a bearing part having a shaft shape and supports the set number of reels such that each reel can rotate individually; and a regulating part regulates positions of the reels in an axis line direction of the bearing part.

3 Claims, 6 Drawing Sheets

(51) Int. Cl.

| | |
|---|---|
| ***B65H 59/04*** | (2006.01) |
| ***D02H 1/00*** | (2006.01) |
| ***D03D 49/06*** | (2006.01) |
| ***D03D 49/16*** | (2006.01) |

(52) U.S. Cl.
CPC ..... *D03D 49/16* (2013.01); *B65H 2701/31* (2013.01)

(58) Field of Classification Search
CPC .... B65H 2701/31; B65H 59/16; D03D 49/16; D03D 49/06
See application file for complete search history.

(56) References Cited

U.S. PATENT DOCUMENTS 1,403,123 A * 1/1922 Leedy ..... B21C 47/28 242/129.6
3,168,995 A * 2/1965 Ostermann ..... B65H 59/04 242/129.8
3,884,274 A * 5/1975 Sujdak ..... B65H 49/325 139/97
3,907,229 A * 9/1975 Iannucci ..... B65H 59/04 242/129.8
4,353,515 A * 10/1982 Weaver ..... B65H 49/26 242/129.6
4,958,784 A * 9/1990 Totten ..... A01K 89/003 242/129.6
5,197,686 A 3/1993 Okada et al.
5,322,236 A * 6/1994 Smith ..... B65H 49/32 118/420
10,167,168 B1 * 1/2019 Bonner ..... B65H 49/32
11,299,367 B2 * 4/2022 Onodera ..... B29C 70/545
2006/0000938 A1 * 1/2006 Miller ..... B65H 59/04 242/422.1
2006/0225465 A1 10/2006 Kinder et al.
2017/0190536 A1 * 7/2017 Worton ..... B65H 49/205
2020/0317463 A1 * 10/2020 Onodera ..... B65H 59/04
2023/0066430 A1 * 3/2023 Hillen ..... B65H 49/20

FOREIGN PATENT DOCUMENTS

JP 2001226856 A * 8/2001
JP 5079296 B2 11/2012
WO WO-2019186003 A1 * 10/2019 ..... B65H 75/4481

* cited by examiner

WARP SUPPLY DEVICE FOR LOOM

CROSS-REFERENCE TO RELATED APPLICATION(S)

This application is based on and claims priority under 35 USC 119 from Japanese Patent Application No. 2022-162058 filed on Oct. 7, 2022, the contents of which are incorporated herein by reference.

TECHNICAL FIELD

The present invention relates to a warp supply device for a loom including reels on each of which a tape-shaped flat yarn as a warp yarn is wound in line, and a creel device in which the same number of the reels as the number of the warp yarn s to be used for weaving in a loom is mounted.

BACKGROUND ART

As a known loom, there is a loom to which a creel device where the same number of yarn supply packages as the number of warp yarn s used for weaving is mounted is attached and in which weaving is performed using yarn s pulled out from the respective yarn supply packages on the creel device as warp yarn s. In addition, there is a loom configured such that weaving is performed using tape-shaped flat yarn s as warp yarn s.

Note that there is a flat yarn that is degraded in quality due to twisting (bending) or the like when it is wound around a winding core to form a yarn supply package and wound while being traversed like a general yarn. Therefore, in the case of preparing such a flat yarn in the form of a yarn supply package, in order to prevent deterioration in quality, it has been practiced in the related art that a reel composed of a winding shaft and a pair of flanges is used as a take-up body (winding frame) for taking up a yarn and a yarn supply package is formed by taking up a flat yarn in line (without traversing) on the reel. Patent Literature 1 discloses an example of a warp supply device in which the reel on which such a flat yarn is wound is used as a yarn supply package.

The warp supply device of Patent Literature 1 is a device in which a strip-shaped carbon fiber bundle subjected to fiber opening is used as a flat yarn to be wound on a reel. More specifically, the warp supply device includes a frame (pedestal), which is a main body of a creel device, and a plurality of shafts for supporting reels are supported with respect to the frame via stays. Note that each shaft is supported to protrude on both sides of the stays, and one reel is supported at each of the portions (protrusions) protruding on both sides of the stays. That is, in the warp supply device, the protrusion of each shaft serves as a support shaft (mandrel) for supporting the reel, and the warp supply device is configured such that one reel (yarn supply package) is supported on each support shaft (the support shaft and the reel are provided in a one-on-one relationship).

CITATION LIST

Patent Literature

Patent Literature 1: JP2001-226856A

In such a warp supply device, as weaving proceeds, the warp wound on the reel decreases, and at the time when an amount of winding becomes equal to or less than a predetermined amount, an operation of replacing the reel being used with a reel on which a warp yarn is fully wound is performed. In this case, in the warp supply device described in Patent Literature 1, the replacement operation is accompanied by a problem in that a heavy burden is placed on an operator and it takes a lot of time.

Specifically, in the case of the (reel-type) yarn supply package using a reel as described above, due to a relationship with a diameter of the reel, the amount of winding of the warp yarn at the time of full winding is smaller than that of a usual yarn supply package on which a yarn is wound while being traversed. Therefore, a period until the amount of winding of the yarn supply package becomes an amount of winding that requires replacement along with the progress of weaving is shorter in the reel-type yarn supply package than in the usual yarn supply package when a weaving speed is the same. As a result, a replacement frequency of the warp supply package is higher in the warp supply device using the reel-type yarn supply package than in the warp supply device using the usual yarn supply package.

In addition, as described above, in the warp supply device of Patent Literature 1, one reel is supported with respect to each support shaft of the creel device. For this reason, in the above-described replacement operation, a reel attaching and detaching operation with respect to the creel device should be performed for each of the same number of reels as the number of warp yarn s used for weaving. In other words, in the replacement operation, the reel attaching and detaching operation with respect to the creel device should be performed the same number of times as the total number of the reels.

As described above, in the warp supply device using a reel-type yarn supply package, the yarn supply package should be replaced at a high replacement frequency as described above, whereas in the warp supply package of Patent Literature 1, the reel attaching and detaching operation with respect to the creel device should be performed for each reel in one replacement operation, which makes the entire operation very complicated and places a heavy burden on the operator. Further, such a large number of times of the attachment and detachment operation increases the time consumed for the operation.

SUMMARY

In view of the above situations, an object of the present invention is to provide a configuration of a warp supply device for a loom having a reel-type yarn supply package mounted to a creel device, which enables a reel replacement operation to be performed in a shorter time and more easily, as compared with devices of the related art.

A preamble of the present invention is a warp supply device for a loom including reels on each of which a tape-shaped flat yarn as a warp yarn is wound in line, and a creel device in which the same number of the reels as the number of the warp yarn s to be used for weaving in a loom is mounted.

In addition, in the present invention, the warp supply device for a loom that is the preamble of the present invention includes, a plurality of support mechanisms provided to be attachable and detachable with respect to the creel device, the plurality of support mechanisms each configured to support a predetermined set number of reels, the predetermined set number is two or more, and each of the plurality of support mechanisms includes: a bearing part having a shaft shape and configured to support the set number of reels such that each reel can rotate individually; and a regulating part configured to regulate positions of the reels in an axis line direction of the bearing part. Note that the "reel" referred to here is a take-up body (winding frame) for taking up a warp yarn, which is composed of a winding shaft and a pair of flanges as described above.

In addition, in the warp supply device for a loom according to the present invention as described above, each of the plurality of support mechanisms may include a resistance applying mechanism configured to apply a rotational resistance to each reel, and the resistance applying mechanism may include a press-contact part configured to be in press-contact with each reel and to apply a press-contact force in order to apply the rotational resistance. In addition, the resistance applying mechanism may be configured such that the press-contact part is provided for each reel and an adjusting part configured to adjust the press-contact force is provided for each press-contact part.

The warp supply device for a loom according to the present invention includes the support mechanisms each configured to support the predetermined set number of reels, which is two or more, and the support mechanisms are each configured to be attachable and detachable with respect to the creel device. Therefore, according to the configuration, the set number of reels is supported by the creel device via one support mechanism. Furthermore, the support mechanism includes not only the bearing part configured to support (pivotally support) the reel but also the regulating part configured to regulate positions of the set number of reels pivotally supported by the bearing part in the axis line direction on the bearing part. Thereby, the set number of reels can be pivotally supported by the bearing part of the support mechanism and positioned in the axis line direction by the regulating part, and can be thus put into a unitized state via the support mechanism.

Therefore, in a stage before mounting the reel to the creel device, by preparing the set number of reels in a unitized state as described above, a reel attaching and detaching operation with respect to the creel device can be performed for each unit (in a unit) in a reel replacement operation. Thereby, according to the present invention, in the warp supply device using, as a yarn supply package, a reel whose replacement frequency is high as described above, the attachment and detachment operation for replacing the reel can be performed in a unit unitized by the set number, not for each reel, so that the number of times of attachment and detachment for replacing all the reels that need to be replaced is reduced, as compared with devices of the related art. As a result, the reel replacement operation can be performed in a short time, and the burden on the operator can be further reduced.

In addition, in the warp supply device of the present invention, each support mechanism includes the resistance applying mechanism for applying the rotational resistance to each reel pivotally supported by the bearing part, so that the reel replacement operation can be performed more easily.

More specifically, in the warp supply device in which the yarn supply package is rotatably mounted, the yarn supply package rotates along with pullout of the warp yarn. However, in order to prevent the warp yarn from being unnecessarily unwound due to excessive rotation of the yarn supply package, the warp supply device is provided with the resistance applying mechanism configured to apply resistance against rotation of the yarn supply package.

In addition, in a general warp supply device, the resistance applying mechanism is provided for the creel device. Therefore, after mounting the yarn supply package to the creel device, for example, an operation of engaging the resistance applying mechanism with the yarn supply package should be performed in order to put the resistance applying mechanism on the creel device side into a state of applying resistance to the yarn supply package. In particular, in the warp supply device of the present invention in which the yarn supplying packages (reels) are unitized so as to be individually rotatable as described above, after mounting the unit body in which the set number of reels are unitized to the creel device, an operation of making a state in which the resistance applying mechanism applies resistance to each of the plurality of reels in the unit body should be performed on the creel device.

In contrast, by configuring each support mechanism to have the resistance applying mechanism, in the stage of unitizing the set number of reels as described above before mounting the reel to the creel device, the unit body can be put into a state in which the resistance has been applied to each reel. Therefore, according to such a configuration, in the reel attaching and detaching operation, it is only necessary to attach and detach the unit body (support mechanism) with respect to the creel device, and it is not necessary to perform the operation of making a state in which the resistance applying mechanism applies resistance to each reel on the creel device, so that the reel replacement operation can be performed more easily.

Further, in the case where each support mechanism is configured to have the resistance applying mechanism as described above, the resistance applying mechanism is configured such that the press-contact part configured to be in press-contact with each reel and to apply the press-contact force is provided for each reel and the adjusting part configured to adjust the press-contact force is provided for each press-contact part, thereby making it possible to prevent uneven tension of the warp yarn pulled out from each reel as much as possible.

More specifically, the warp yarn s pulled out from the creel device are aligned in a width direction in a process of reaching the loom, and a path length of each warp yarn to reach the loom is different for each warp yarn due to the position of each reel on the creel device. In this case, if the resistance applying mechanism is configured to apply the press-contact force of the same magnitude to each reel, a difference (unevenness) is caused in the tension of the warp yarn s due to the difference in the path length. If unevenness is caused in the tension of the warp yarn s in this way, the quality of the fabric to be woven may deteriorate in some cases.

In contrast, the resistance applying mechanism has such a configuration that the press-contact part configured to apply the press-contact force to each reel is provided for each reel and the adjusting part configured to adjust the press-contact force is provided for each press-contact part, so that the press-contact force can be adjusted individually for each of the reels in the unit body. Therefore, according to this configuration, the press-contact force applied by the press-contact part is set to a magnitude corresponding to each reel by the adjusting part, so that unevenness in the tension of warp yarn s pulled out from the respective reels can be prevented as much as possible.

DESCRIPTION OF EMBODIMENTS

Hereinafter, one embodiment of a warp supply device for a loom to which the present invention is applied will be described with reference to FIGS. 1 to 6.

Figure 1:
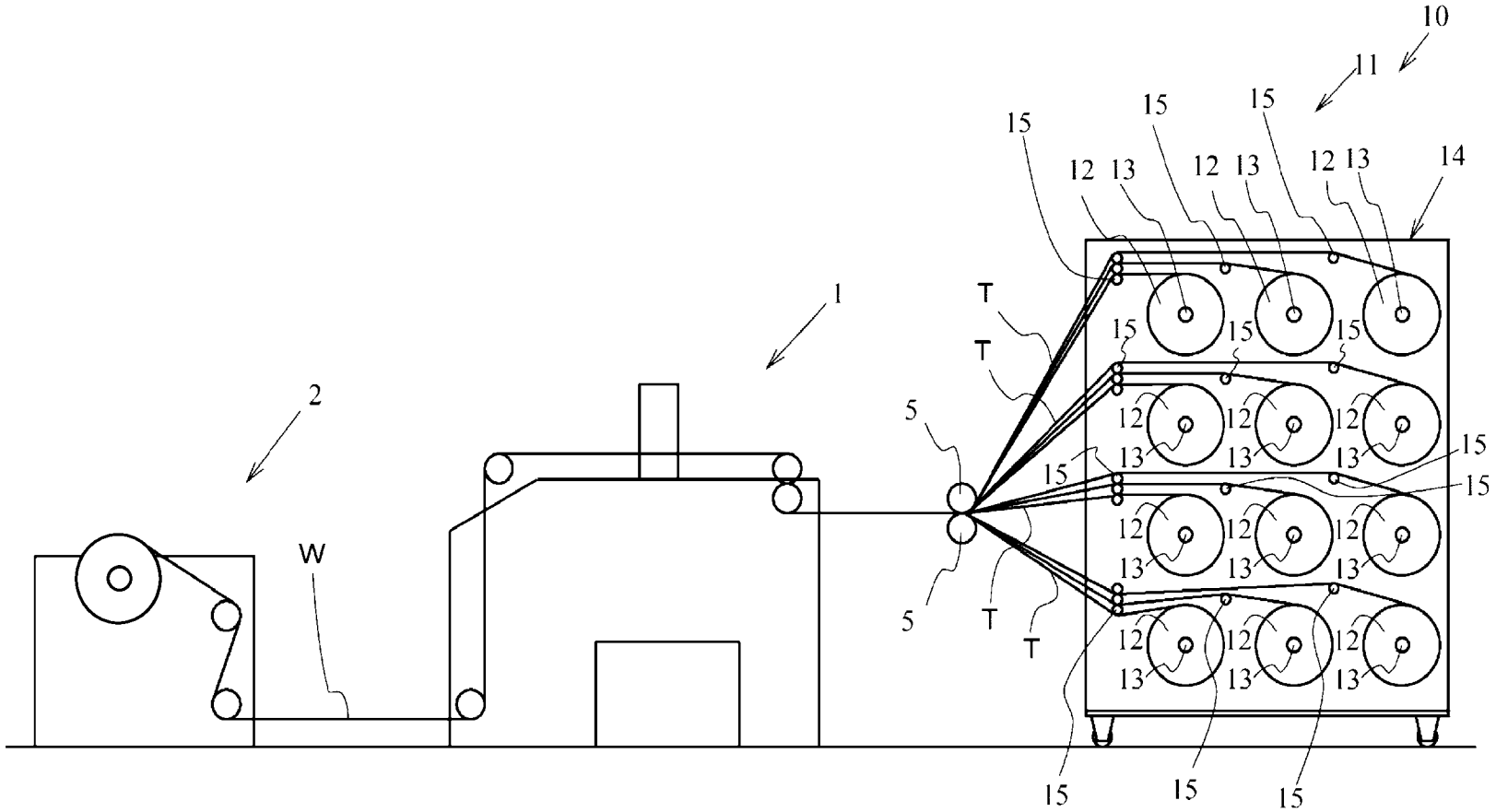
FIG. 1 illustrates an outline of a warp supply device for a loom, a loom, and an off-loom take-up device according to the present invention.
Figure 2:
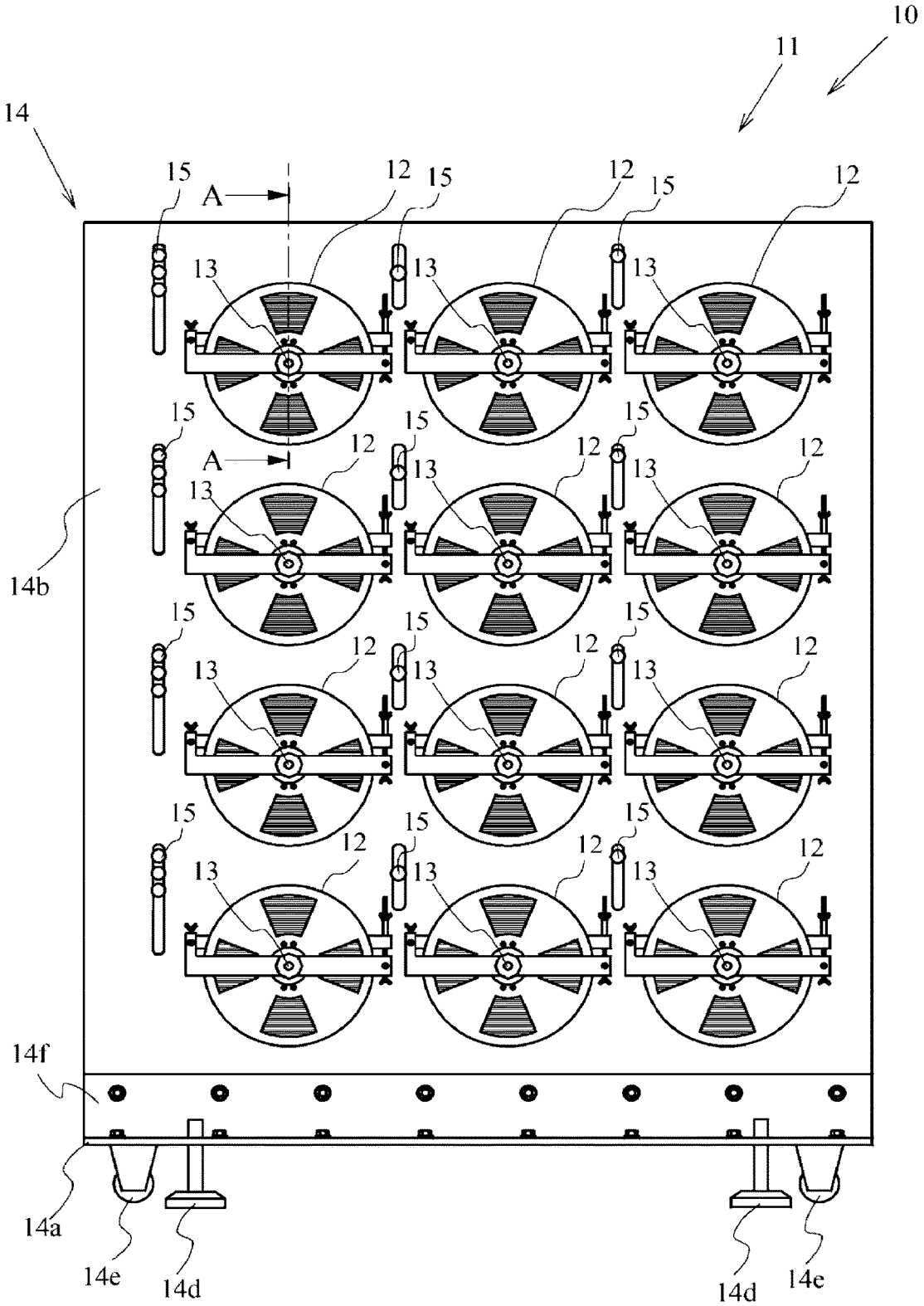
FIG. 2 is a side view showing one embodiment of the warp supply device for a loom according to the present invention.
Figure 3:
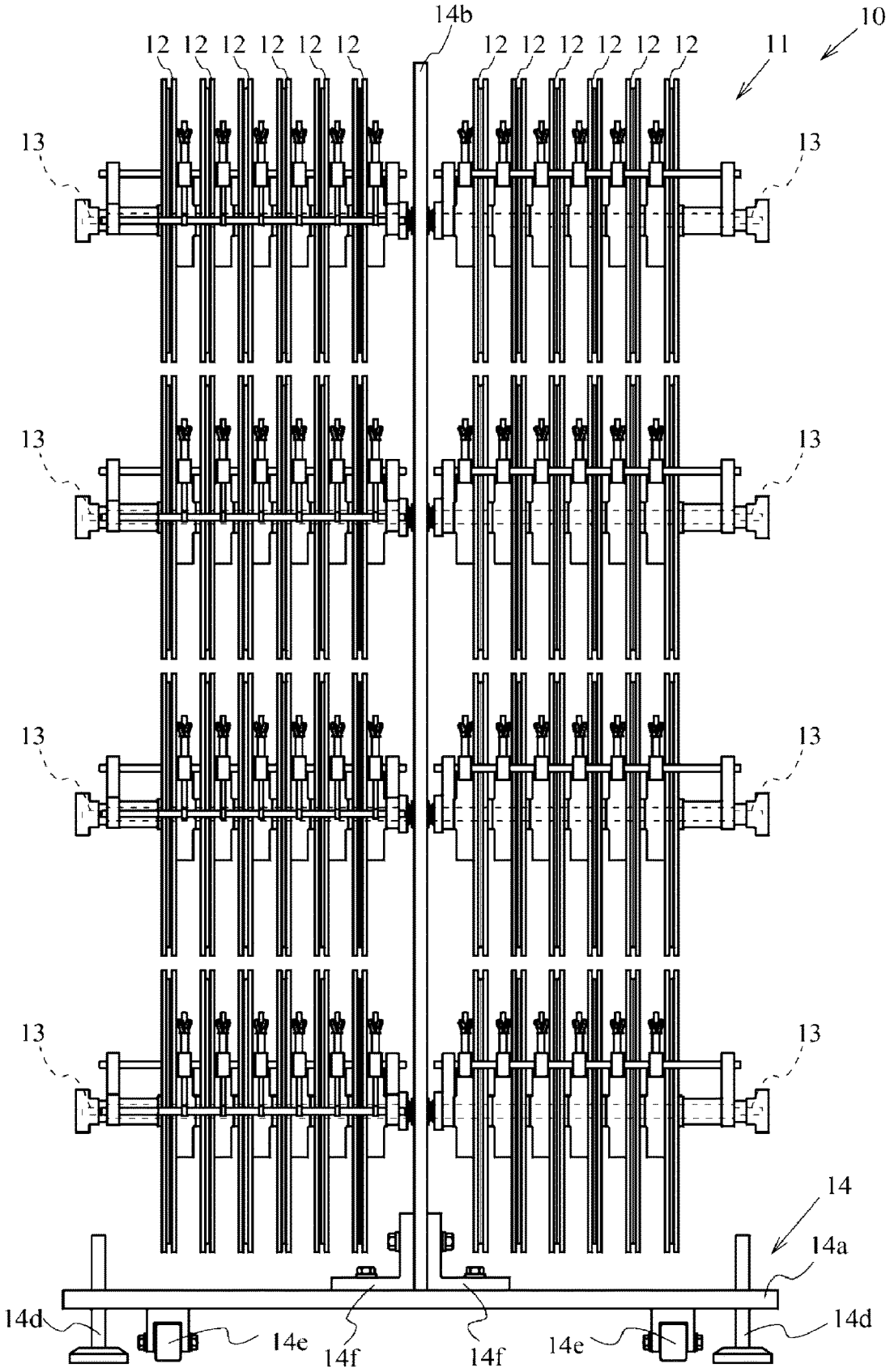
FIG. 3 is a front view of the warp supply device.
Figure 4:
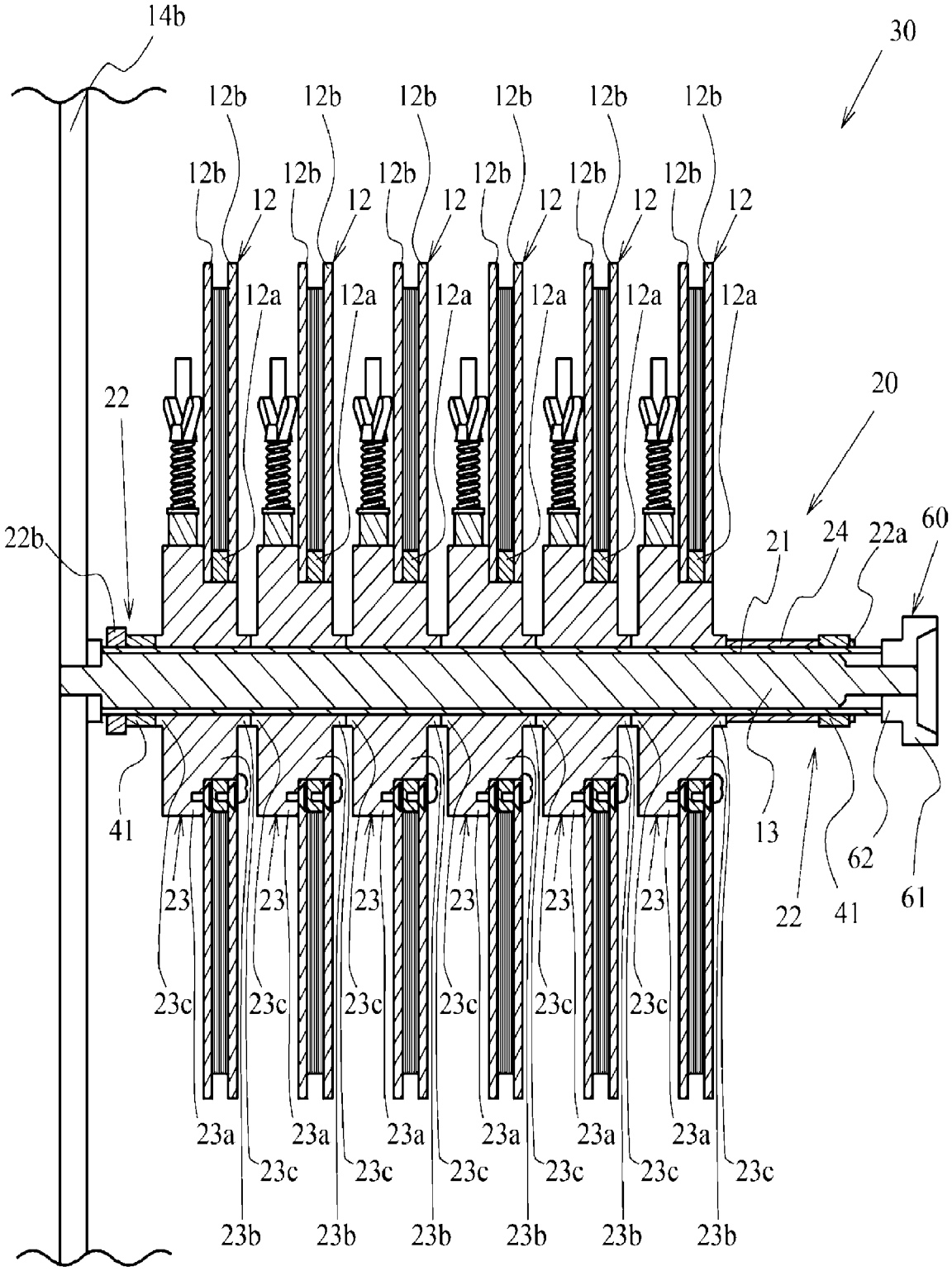
FIG. 4 is a cross-sectional view taken along an A-A line in FIG. 2.
Figure 5:
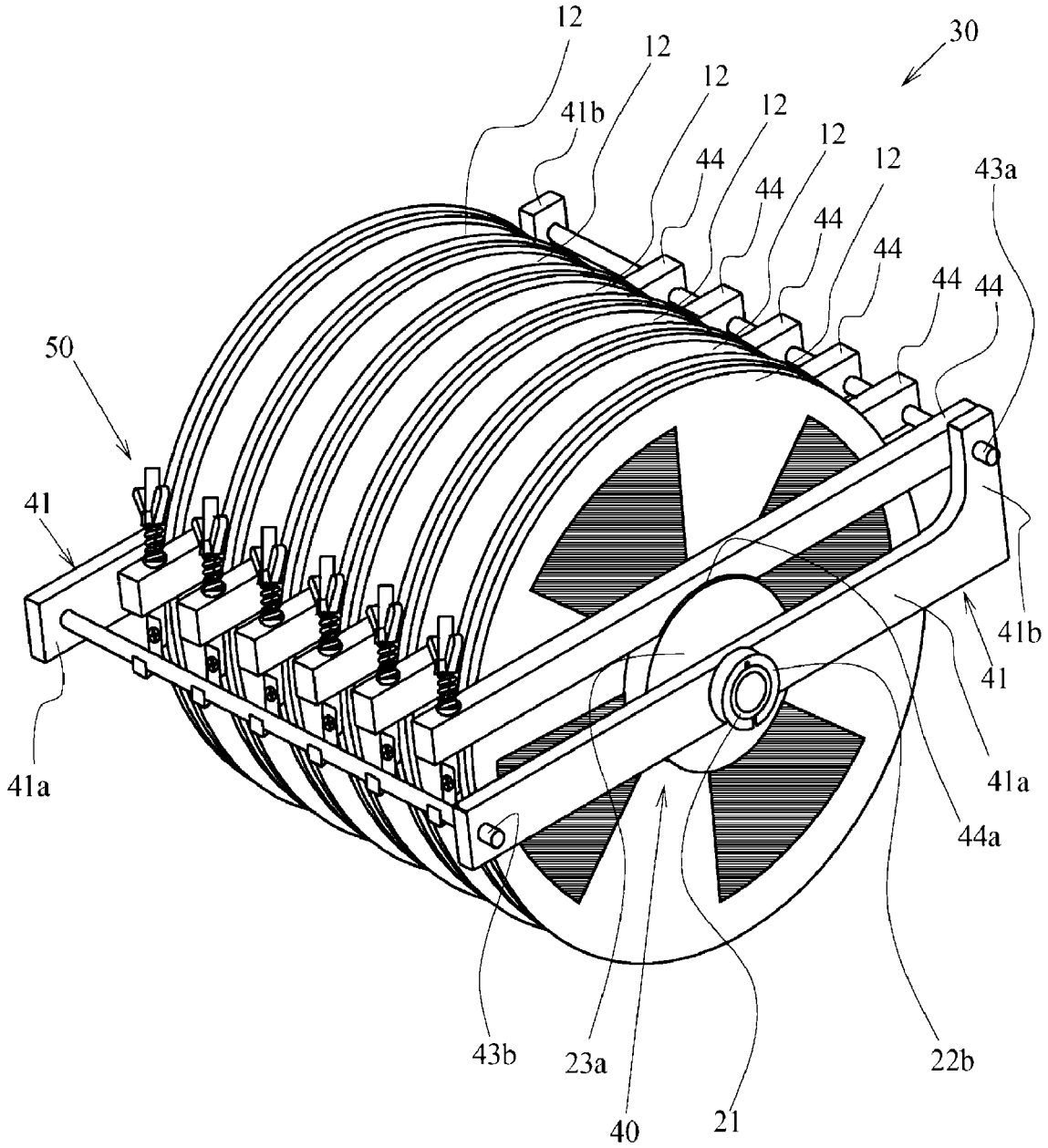
FIG. 5 is a perspective view of a support mechanism of the warp supply device, as seen from the rear.
Figure 6:
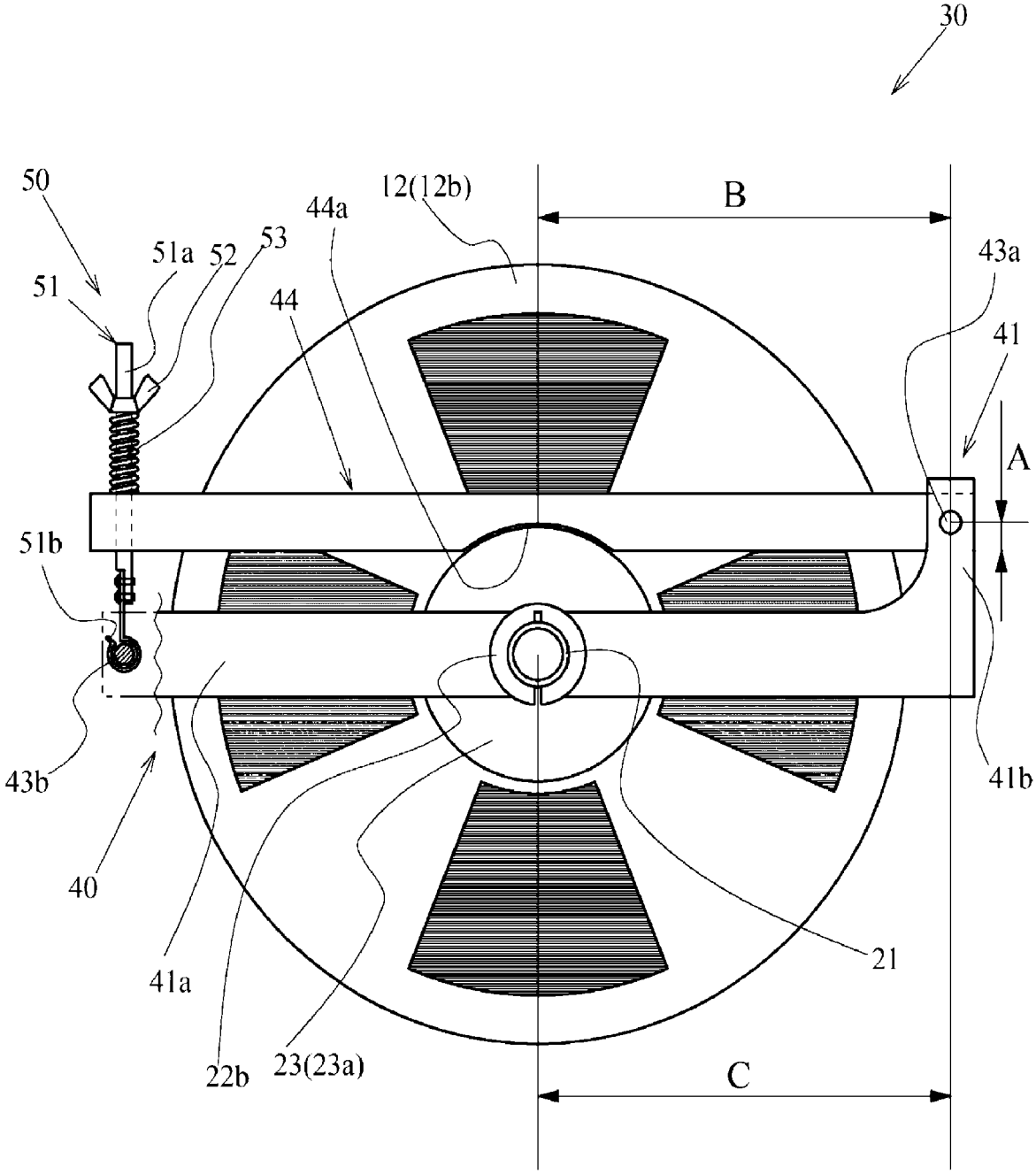
FIG. 6 is a side view of the support mechanism in FIG. 5.

FIG. 1 schematically shows a loom (for example, a rapier loom) 1 for weaving and a warp supply device 10 for a loom attached to the loom 1. The warp supply device 10 includes a creel device 11 for mounting reels 12 on each of which a warp yarn T is wound.

Note that the warp yarn T is, for example, a tape-shaped prepreg tape in which carbon fiber is impregnated with a thermoplastic resin as a matrix resin. The thermoplastic prepreg tape is taken up in line (without traversing) on the reel 12. However, in the present invention, the warp yarn T is not limited to such a thermoplastic prepreg tape, and may be any other flat yarn as long as a quality thereof would degrade as it is wound while being traversed around a winding shaft.

The creel device 11 has, as a main body, a frame 14 for mounting the reels 12 thereto. The frame 14 is provided with a plurality of support shafts 13 for supporting the reels 12. The plurality of support shafts 13 is provided in a shape of forming rows at equal intervals in vertical and lateral directions with respect to the frame 14. In addition, the reels 12 are each rotatably supported with respect to each of the support shafts 13. Note that, in FIG. 1, the creel device 11 is shown in such a form that 12 support shafts 13 are provided for the frame 14. However, as described below, for the creel device 11 of the present embodiment, the support shafts 13 are similarly provided even on a surface opposite to the shown surface of the frame 14. Therefore, the creel device 11 has the 24 support shafts 13.

In addition, the creel device 11 has a guide roller 15 for guiding the warp yarn T pulled out from each reel 12. The guide rollers 15 are provided in the vicinity of each of the support shafts 13 and arranged such that the warp yarn s T pulled out from the respective reels 12 can be guided without overlapping the respective warp yarn s T. In addition, each guide roller 15 is provided to be rotatable with respect to the frame 14 in order to reduce sliding resistance with the warp yarn T. The warp yarn T wound on each reel 12 is pulled out from the warp supply device 10 via the corresponding guide roller 15.

Further, a pair of guide rollers 5 and 5 is provided between the warp supply device 10 and the loom 1. The warp yarn s T pulled out from the warp supply device 10 are caused to pass between the pair of guide rollers 5 and 5 and are thus brought into a state aligned in a lateral row. Further, the warp yarn s T are supplied to the loom 1 in such an aligned state, and weaving is performed in the loom 1. For reference, in the shown example, a take-up device for taking up the woven fabric W is an off-loom take-up device 2 provided independently of the loom 1. After leaving the loom 1, the fabric W woven in the loom 1 is taken up by the off-loom take-up device 2.

In the warp supply device 10 for a loom configured as described above, in the present invention, the warp feed device 10 includes a plurality of support mechanisms for supporting a set number of the reels 12, which is two or more, and each of the support mechanisms is configured to be attachable and detachable with respect to the creel device 11. Each of the support mechanisms is configured to have a bearing part that has a shaft shape and supports the set number of reels 12, and a regulating part that regulates positions, on the bearing part, of the set number of reels 12 in an axis line direction of the bearing part.

Further, in the present embodiment, each of the support mechanisms is configured to have a resistance applying mechanism for applying rotational resistance to each reel 12 supported by the bearing part. Further, in the present embodiment, the resistance applying mechanism is configured such that a press-contact part that is in press-contact with each reel 12 and applies a press-contact force is provided for each reel 12, and an adjusting part that adjusts the press-contact force is provided for each press-contact part. The configuration of the warp supply device 10 including such support mechanisms will be described in detail with reference to FIGS. 2 to 6.

First, as for the creel device 11, the creel device 11 has, as a main body, the frame 14 to which the reels 12 are mounted, as described above. In addition, the frame 14 is configured by a base part 14*a* serving as a base of the frame 14 and an upright plate part 14*b* provided substantially perpendicularly to the base part 14*a*.

In addition, both the base part 14*a* and the upright plate part 14*b* have a plate shape, and are formed to form a rectangular shape when seen in a plate thickness direction. Further, the upright plate part 14*b* is placed upright on the base part 14*a* in such a way that a long side direction of a plate surface is parallel to the vertical direction and a short side direction is parallel to a side edge of the base part 14*a*. Note that the upright plate part 14*b* is attached to the base part 14*a* in such a way that the upright plate part 14*b* is sandwiched by two L-shaped stays 14*f* and 14*f* fixed to a plate surface of the base part 14*a*.

The upright plate part 14*b* is a part having one surface to which the 12 support shafts 13 provided for the frame 14 are attached, as described above. In addition, the 12 support shafts 13 are arranged in such a way that three are aligned in the short side direction and the rows each of which is composed of the three support shafts 13 are present in four stages in the long side direction. In addition, since the reels 12 are mounted to the respective support shafts 13, intervals between the support shafts 13 in the short side direction and the long side direction are set larger than a diameter of the reel 12. However, the interval between the support shafts 13 in the short side direction is such that a slight gap is present between the adjacent reels 12 and 12 in a state in which the reels 12 are mounted to the respective support shafts 13. In addition, the interval between the support shafts 13 in the long side direction is such that the guide roller 15 can be arranged between the adjacent reels 12 and 12 in a state in which the reels 12 are mounted to the respective support shafts 13.

In addition, sizes of the upright plate part 14*b* in the short side direction and the long side direction are such that all the reels 12 are located within a presence range of the upright plate part 14*b* in the state in which the reels 12 are mounted to the respective support shafts 13, when seen in the plate thickness direction of the upright plate part 14*b*. Note that each support shaft 13 is attached to the upright plate part 14*b* in such a way that each support shaft 13 is screwed into a female screw hole formed in the upright plate part 14*b*.

Further, in the frame 14, the base part 14*a* is provided with leg portions 14*d* at each position of four corners, when seen in the plate thickness direction. The leg portion 14*d* is configured to be able to adjust a height position (a distance from a floor surface to the base part 14*a*) of the base part 14*a*. That is, each of the leg portions 14*d* is configured such that an amount of protrusion from a lower surface of the base part 14*a* can be changed. In addition, casters 14*e* are attached to the base part 14*a* in the vicinity of each leg portion 14*d* in the form of being attached to the lower surface thereof. In an installed state of the frame 14, the amount of protrusion of the leg portion 14*d* is greater than a height of the caster 14*e*, and therefore, the caster 14*e* is separated from the floor surface. Further, when the amounts of protrusion of the leg portions 14*d* become smaller than the heights of the casters 14*e* by changing the amounts of protrusion, the casters 14*e* come into contact with the floor surface and the frame 14 is put into a movable state.

A support mechanism 20 provided to be attachable and detachable with respect to the creel device 11 is configured to support the set number of reels 12, which is predetermined two or more, as described above. Note that it is assumed that the set number is 6 (six) in the present embodiment. That is, in the warp supply device 10 of the present embodiment, the six reels 12 are supported by each support mechanism 20. The six reels 12 are supported (pivotally supported) with respect to a bearing part 21 of the support mechanism 20, and positions of the reels 12 on the bearing part 21 are regulated by a regulating part 22, so that a unit body 30 in which the six reels 12 and the support mechanism 20 are unitized is formed.

As for the unit body 30, the support mechanism 20 includes the bearing part 21 and the regulating part 22, as described above. Among others, the bearing part 21 is a pipe-shaped member having a through-hole. An inner diameter of the through-hole in the bearing part 21 is large enough to fit the support shaft 13 therein. In addition, a dimension in the axis line direction of the bearing part 21 is slightly smaller than a dimension in an axis line direction of the support shaft 13.

In addition, the regulating part 22 regulates the position of the reel 12 on the bearing part 21, as described above. However, in the present embodiment, a combination of a plurality of members functions as the regulating part 22. Specifically, a snap ring 22*a* is provided at an end portion (one end portion) on one side of the bearing part 21. Note that the snap ring 22*a* is attached in the form of being fitted in a groove formed on an outer circumferential surface of the bearing part 21, and is provided in a state in which a position thereof in the axis line direction of the bearing part 21 is fixed.

In addition, an annular positioning member 22*b* is provided at an end portion (other end portion) on the other side of the bearing part 21. Note that the positioning member 22*b* has a split clamping structure, and a position thereof on the bearing part 21 is fixed by fastening fixing by the split clamping structure. Therefore, the positioning member 22*b* is adapted to be able to change the fixed position on the bearing part 21. An interval between the snap ring 22*a* and the positioning member 22*b* on the bearing part 21 is set to be larger than a presence range of the reels 12 in a state (arrangement state) in which the six reels 12 are arranged on the bearing part 21 as described below.

Further, in the present embodiment, the support mechanism 20 is configured to include a resistance applying mechanism 40, as described above. In addition, a pair of lever members 41 and 41 forming a part of the resistance applying mechanism 40 is provided to be positioned on the bearing part 21. The pair of lever members 41 and 41 is provided in such a way that the bearing part 21 is inserted into through-holes formed in central portions thereof. The pair of lever members 41 and 41 is arranged such that one is adjacent to the snap ring 22*a* and the other is adjacent to the positioning member 22*b* with respect to the axis line direction of the bearing part 21.

Further, on the bearing part 21, a collar member 24 is provided to be adjacent to the one lever member 41. Note that the collar member 24 is a pipe-shaped member, and an inner diameter thereof is large enough to be in a loose-fitting state with respect to the bearing part 21. In addition, the collar member 24 has such a size that it is present between the one lever member 41 and the reel 12 in the arrangement state. On the bearing part 21, the positions of the six reels 12 on the bearing part 21 are regulated on the other end portion side by the positioning member 22*b* and the other lever member 41, and are regulated on the one end portion side by the snap ring 22*a*, the one lever member 41 and the collar member 24. Therefore, in the present embodiment, a combination of the snap ring 22*a*, the positioning member 22*b*, the pair of lever members 41 and 41, and the collar member 24 corresponds to the regulating part.

Further, the reel 12 is of a general configuration, and is composed of a winding shaft 12*a* having a through-hole penetrating in the axis line direction, and a pair of flange portions 12*b* and 12*b* fixed on the winding shaft 12*a* at an interval. Note that the interval between the pair of flange portions 12*b* and 12*b* is slightly larger than a width dimension of the tape-shaped warp yarn T. Therefore, in the reel 12, the warp yarn T is wound in line (without traversing) on the winding shaft 12*a* between the pair of flange portions 12*b* and 12*b*. Further, although the reel 12 is supported with respect to the support mechanism 20 (bearing part 21) as described above, in the present embodiment, the support is performed via a reel support part 23 to which the reel 12 is fixed.

The reel support part 23 has a disk shape, and an insertion portion 23*b* serving as a portion in which the reel 12 is inserted and a collar portion 23*a* having a larger diameter than the insertion portion 23*b* are integrally formed. In addition, the reel support part 23 composed of the insertion portion 23*b* and the collar portion 23*a* has a through-hole penetrating through a center thereof in a thickness direction. An inner diameter of the through-hole is such that the reel support part 23 can be inserted and rotated with respect to the bearing part 21. Further, the reel support part 23 has a pair of protrusions 23*c* and 23*c* formed to protrude in the thickness direction around the through-hole on both end faces in the thickness direction.

Note that a dimension in the thickness direction of the insertion portion 23*b* of the reel support part 23 is substantially the same as the dimension in the axis line direction of the reel 12. In addition, a dimension in the thickness direction of the collar portion 23*a* is substantially the same as that of the insertion portion 23*b* in the shown example. Further, the reel 12 is mounted to the reel support part 23 by means of a screw member or the like in a state in which the insertion portion 23*b* of the reel support part 23 is inserted in the through-hole of the reel and in contact with an end surface of the collar portion 23*a*.

Each reel 12 is supported with respect to the bearing part 21 via the reel support part 23 in such a way that the bearing part 21 is inserted in the through-hole of the reel support part 23. As a result, the six reels 12 are in the arrangement state described above. Further, in the arrangement state, each reel support part 23 is oriented in the same direction, and is arranged on the bearing part 21 in such an orientation that the insertion portion 23*b* is disposed on the one end portion side (snap ring 22*a* side) of the bearing part 21 with respect to the collar portion 23*a*. Therefore, an interval between the adjacent reels 12 and 12 is defined by dimensions in the thickness direction of the collar portion 23*a* and the two protrusions 23*c* and 23*c* of the reel support part 23.

Note that the reel support part 23 is formed of a material with a lower friction coefficient than that of the bearing part 21. Thereby, the reel support part 23 can rotate with respect to the bearing part 21 with less frictional resistance. In addition, the reel support parts 23 and 23 adjacent to each other on the bearing part 21 abut against each other at the respective protrusions 23*c* in the arrangement state. However, since the reel support parts are formed of a material with low frictional resistance, they can individually rotate without inhibiting relative rotation of each other.

Further, in the arrangement state, the positions of the reels 12 (reel support parts 23) on the bearing part 21 are regulated by the regulating part 22, so that the six reels 12 are unitized with the support mechanism 20 including the bearing part 21 and a unit body 30 is thus formed.

In addition to the pair of lever members 41 and 41 described above, the resistance applying mechanism 40 includes a braking member 44 as a press-contact part that is in press-contact with each reel 12 and applies a press-contact force. The braking member 44 is provided for each reel 12. That is, the resistance applying mechanism 40 includes six braking members 44 in the form of corresponding to each reel 12. In addition, the resistance applying mechanism 40 includes an adjusting mechanism 50 as an adjusting part for adjusting the press-contact force that is applied to the corresponding reel 12 by the braking member 44.

Specifically, each lever member 41 is a lever-shaped member having, as a main body, a supported portion 41*a* that is a part in which the bearing part 21 is inserted as described above and which is supported by the bearing part 21. Note that the supported portion 41*a* is formed to have a rectangular shape whose dimension in a long side direction is sufficiently longer than a dimension in a short side direction, when seen in a thickness direction thereof. The dimension in the long side direction of the supported portion 41*a* is larger than an outer diameter of the reel 12 (flange portion 12*b*).

Further, each lever member 41 is an L-shaped member as a whole having an extension portion 41*b* extending in a direction (a direction substantially parallel to the short side direction of the supported portion 41*a*) substantially orthogonal to the long side direction of the supported portion 41*a* at one end portion of the supported portion 41*a*. Note that the extension portion 41*b* is also formed to have a substantially rectangular shape when seen in a thickness direction thereof. In addition, a dimension of the extension portion 41*b* in the extension direction from the supported portion 41*a* is such that a distance from a center of the supported portion 41*a* to a distal end of the extension portion 41*b* in the short side direction of the supported portion 41*a* is larger than a radius of the collar portion 23*a* of the reel support part 23. Accordingly, in a state in which the lever member 41 is supported by the bearing part 21, as the arrangement state of the reel 12, the distal end of the extension portion 41*b* is located outside (upward) the presence range of the collar portion 23*a* of the reel support part 23.

Further, a first support rod 43*a* for supporting the braking members 44 are bridged between the distal ends of the extension portions 41*b* and 41*b* of the pair of lever members 41 and 41 of the resistance applying mechanism 40. In the support mechanism 20 in which the reel 12 is in the arrangement state, the first rod 43*a* is attached to each lever member 41 at a position where a position of a shaft center of the first rod substantially coincides with a position of a vertex of the outer circumferential surface of the collar portion 23*a* of the reel support part 23 with respect to the short side direction of the supported portion 41*a* (a radial direction of the collar portion 23*a*). Note that attachment of the first support rod 43*a* to the lever members 41 is performed in such a way that the first support rod 43*a* is non-rotatably inserted into a hole formed in each of the extension portions 41*b*.

In addition, a second support rod 43*b* on which the adjusting mechanism 50 is hooked is bridged between the other end portions of the supported portions 41*a* of the pair of lever members 41 and 41 (end portions on an opposite side to the side on which the extension portions 41*b* are provided). Similar to the attachment of the first support rod 43*a*, the attachment of the second support rod 43*b* to the supported portion 41*a* is also performed in such a way that the second support rod 43*b* is non-rotatably inserted into holes formed in the supported portions 41*a*. Thereby, in the resistance applying mechanism 40, the frame body is formed by the pair of lever members 41 and 41, the first support rod 43*a* and the second support rod 43*b*.

Each braking member 44 is a lever-shaped member whose cross section is formed in a substantially prismatic shape with a rectangular shape, and is a member whose dimensions in long side directions of both side surfaces (surfaces orthogonal to the thickness direction) and both end surfaces (surfaces parallel to the thickness direction) each forming a rectangular shape are sufficiently large with respect to dimensions in short side directions. In addition, a dimension of the braking member 44 in a longitudinal direction (long side direction of the side surface and the end face) is slightly larger than the dimension of the supported portion 41*a* of the lever member 41 in the long side direction. Further, a thickness dimension of the braking member 44 is slightly smaller than a dimension of the collar portion 23*a* in the thickness direction of the reel support part 23.

The braking member 44 is supported to be swingable with respect to the first support rod 43*a* in such a manner that the first support rod 43*a* is inserted into a hole formed to penetrate through one end portion of the braking member in the thickness direction. That is, each braking member 44 has a shaft center of the first support rod 43*a* as a support center and is provided to be swingable about the support center as a swing center. Note that, as described above, the six braking members 44 are provided in the form of corresponding to the six reels 12, respectively. In addition, in the support mechanism 20 in which the reel 12 is in the arrangement state, each braking member 44 is arranged to be located within the presence range of the collar portion 23*a* of the reel support part 23 that supports the corresponding reel 12. Therefore, in a state of being supported by the first support rod 43*a*, each braking member 44 is in a state in which one of the end faces thereof faces the outer circumferential surface of the collar portion 23*a* of the corresponding reel support part 23.

In addition, each braking member 44 is provided with an arc-shaped groove (arc groove) 44*a*, which is formed in such a way that the one end surface is depressed. The arc groove 44*a* is formed to have the same curvature as that of the outer circumferential surface of the collar portion 23*a* of the reel support part 23. Further, a depth dimension of the arc groove 44*a* is substantially the same as a distance A from the one end surface of the braking member 44 to a center of the hole in which the first support rod 43*a* is inserted.

Further, in the support mechanism 20 in which the reel 12 is in the arrangement state, the arc groove 44*a* is formed at a position where a distance B from the support center of the braking member 44 to a center of the arc groove 44*a* in the longitudinal direction of the braking member 44 substantially coincides with a distance C from the support center (a center of the hole in the extension portion 41*b* where the first support rod 43*a* is inserted) to a center of the collar portion 23*a* of the reel support part 23 (a center of the hole in the supported portion 41*a* where the bearing part 21 is inserted) in the long side direction of the supported portion 41*a* of the lever member 41. Thereby, in the support mechanism 20, each braking member 44 is in a state in which an inner surface of the arc groove 44*a* can abut against the outer circumferential surface of the collar portion 23*a* over its entire surface in a state of being substantially parallel to the supported portion 41*a*.

In addition, the resistance applying mechanism 40 includes the adjusting mechanism 50 that urges each braking member 44, which is in a state in which it can abut against the collar portion 23*a* of the reel support part 23, toward the collar portion 23*a*. In addition, the adjusting mechanism 50 is configured to be able to adjust a force (urging force) to be urged to the braking member 44. Each adjusting mechanism 50 includes, as its constitutional elements, a main body part 51 that becomes a main body of the adjusting mechanism 50, a nut member 52 screwed to the main body part 51, and a spring member 53 for applying the urging force.

As for each component, specifically, the main body part 51 is composed of a rod-shaped rod member 51*a* and a hook member 51*b* attached to one end portion of the rod member 51*a*. In addition, the hook member 51*b* is a member formed by bending a plate material to form a substantially J-shape when seen in a direction parallel to a plate surface. The main body part 51 is formed in such a way that the hook member 51*b* is attached by means of a screw member to a flat portion formed on a circumferential surface of one end portion of the rod member 51*a*.

In the support mechanism 20 in which the reel 12 is in the arrangement state, the main body part 51 is provided in such a way that the hook member 51*b* is hooked to the second support rod 43*b*. Note that at the other end portion of each braking member 44 (an end portion on a side opposite to the side supported by the first support rod 43*a*), an insertion hole penetrating in a direction parallel to the end face thereof (a direction orthogonal to the end face) is formed. The insertion hole has an inner diameter slightly larger than an outer diameter of the rod member 51*a*.

In addition, in a state of being hooked to the second rod 43*b* at the hook member 51*b* as described above, the main body part 51 is provided in a state in which the rod member 51*a* is inserted in the insertion hole of the braking member 44. Therefore, a length dimension of the main body part 51 formed by combining the rod member 51*a* and the hook member 51*b* as described above is such that the main body part protrudes upward beyond the other end surface of the braking member 44 in a state of being in contact with the collar portion 23*a* (an end surface on a side opposite to the side where the arc groove 44*a* is provided) in a state in which the main body part is hooked to the second support rod 43*b* and the rod member 51*a* is directed toward the braking member 44 in a direction orthogonal to the long side direction of the supported portion 41*a*. More specifically, the main body part 51 is formed to have such a length dimension that the end face on the other side of the braking member 44 is located at a substantially middle portion of the main body part in a state in which the main body part is inserted in the insertion hole of the braking member 44 as described above.

Further, in the main body part 51, a male screw portion is formed at the other end portion of the rod member 51*a* (an end portion on a side opposite to the one end portion to which the hook member 51*b* is attached). Further, the nut member 52 is attached in the form of being screwed onto the male screw portion of the rod member 51*a*. Note that the nut member 52 is a wing nut and can be rotated manually by an operator without using a tool, and a rotation operation thereof facilitates changing a screwing position on the rod member 51*a*.

In addition, the spring member 53 is mounted between the nut member 52 and the braking member 44 in the form of being inserted into a portion protruding from the braking member 44 of the rod member 51*a* of the main body 51. Note that the male screw portion of the rod member 51*a* is formed such that the nut member 52 can be arranged at a position where an interval from the braking member 44 becomes smaller than a natural length of the spring member 53. By putting the spring member 53 into a compressed state by the arrangement of the nut member 52 (the screwing position), the braking member 44 is always urged toward the collar portion 23*a* of the reel support part 23 by the spring member 53.

Further, by changing the position of the nut member 52 on the rod member 51*a* to change an amount of compression of the spring member 53, the urging force is changed. In other words, the adjusting mechanism 50 is configured such that when the screwing position of the nut member 52 to the main body part 51 (rod member 51*a*) is changed, the braking member 44 is urged toward the collar portion 23*a*, and accordingly, the press-contact force acting on the reel 12 (collar portion 23*a*) corresponding to each braking member 44 is changed (adjusted).

The unit body 30 configured as above is supported with respect to the creel device 11 in such a form that the bearing part 21 of the support mechanism 20 is fitted to the support shaft 13 of the creel device 11. Therefore, the creel device 11 includes a mechanism that fixes a position in the axis line direction to the support shaft 13 of the unit body 30 in a state of being fitted to the support shaft 13.

More specifically, as described above, the dimension of the bearing part 21 in the axis line direction is slightly smaller than the dimension of the support shaft 13 in the axis line direction. Therefore, in a state in which the unit body 30 is fitted, an end portion on one end side of the support shaft 13 (an end portion on a side opposite to a side attached to the upright plate part 14*b* in the creel device 11) protrudes from the unit body 30. In addition, a distal end portion including the protruding portion (protrusion) of the support shaft 13 is formed so that an outer diameter thereof is smaller than that of the other portion. The distal end portion is formed with a male screw, forming a male screw portion.

In addition, the creel device 11 has a handle member 60 that is screwed to the distal end portion (male screw portion) of each support shaft 13. The handle member 60 has a disk shape, and is formed so that a portion on one end side with respect to a middle portion in a thickness direction becomes a large-diameter portion 61 whose diameter is enlarged. The large-diameter portion 61 of the handle member 60 becomes an operation portion that an operator grips and operates by hand. In addition, an outer diameter of a small-diameter portion 62 excluding the operation portion (large-diameter portion) 61 of the handle member 60 is larger than the outer diameter of the bearing part 21. Further, the handle member 60 is formed with a through-hole penetrating through in the thickness direction. The through-hole has a female screw formed on its inner circumferential surface to form a female screw portion. The female screw portion is sized to screw with the male screw portion of the support shaft 13.

Further, in the warp supply device 10, in a state in which the unit body 30 is fitted to each support shaft 13 of the creel device 11, the handle member 60 is screwed to the protrusion at the distal end portion of the support shaft 13. Note that the handle member 60 is screwed to the support shaft 13 in a state in which the small-diameter portion 62 is directed toward the unit body 30 (bearing part 21).

When the operator grips the handle member 60 (operation portion 61) with a hand and operates to rotate it in a tightening direction, the handle member 60 is moved toward the unit body 30 (bearing part 21), and the handle member 60 comes into contact with the unit body 30 (bearing part 21) on an end face on the small-diameter portion 62 side. Then, when the handle member 60 is rotated in the further tightening direction from that state, the bearing part 21 is sandwiched by the handle member 60 and the creel device 11 (upright plate part 14*b*). Thereby, the unit body 30 becomes in a state in which the position on the support shaft 13 is fixed and the unit body is supported non-rotatably with respect to the support shaft 13 (creel device 11).

In the warp supply device 10 configured as described above, the six reels 12 are unitized to form one unit body 30 by the support mechanism 20, and are mounted to the reel device 11 in the form of the unit body 30. Therefore, according to such a warp supply device 10, in a replacement operation of the reel 12, when attaching and detaching the reels 12 with respect to the creel device 11, the reels 12 are attached and detached for each unit body 30, and the six reels 12 can be thus attached and detached in one operation.

Thereby, the number of times of attachment and detachment operations for replacing the reels 12 is reduced corresponding to the number of reels 12 constituting the unit body 30, as compared with a case of replacing the reels 12 one by one. Since a great number of reels 12 should be replaced as a whole of the warp supply device 10, by being able to perform the replacement in a unit of the unit body 30 in this way, the replacement operation of the reels 12 can be performed in a short time, and the burden on the operation is reduced.

In addition, in the warp supply device 10 of the present embodiment, each support mechanism 20 is provided with the resistance applying mechanism 40 for applying resistance to each reel 12. Therefore, according to the configuration, in the stage of forming the unit body 30 by the six reels 12 and the support mechanism 20, i.e., in the stage before mounting the reels 12 (unit body 30) to the creel device 11, a state in which resistance is applied to each reel 12 can be realized by the resistance applying mechanism 40. Thereby, in the attachment and detachment operation of the reels 12, it is only necessary to attach and detach the unit body 30 with respect to the creel device 11, and it is not necessary to perform the operation of making a state in which resistance is applied to each reel 12 on the creel device 11, so that the replacement operation of the reels 12 can be performed more easily.

Further, the resistance applying mechanism 40 includes the press-contact part (braking member) 44 that is provided for each reel 12 and applies the press-contact force to the corresponding reel 12, and the adjusting part (adjusting mechanism) 50 that adjusts the press-contact force and is provided for each contact part 44, and is configured so that the press-contact force can be adjusted for each press-contact part 44. Therefore, according to the configuration, the press-contact force that is applied to each reel 12 by the press-contact part 44 can be adjusted to the force corresponding to each reel 12, so that unevenness in the tension of the warp yarn s T pulled out from the respective reels 12 can be prevented. As a result, a problem that a quality of a fabric to be woven is deteriorated due to unevenness is prevented as much as possible.

In the above, one embodiment (hereinafter, referred to as 'above embodiment') of the warp supply device to which the present invention is applied has been described. However, the present invention is not limited to the above embodiment, and can also be implemented by other embodiments (modified embodiments) as described below.

(1) As for the resistance applying mechanism, in the above embodiment, the braking member 44 as a press-contact part is provided to abut against the collar portion 23*a* of the reel support part 23 for supporting the corresponding reel 12, and applies the rotational resistance to the reel 12 by applying the press-contact force to the collar portion 23*a*. However, in the present invention, the resistance applying mechanism is not limited to the configuration where the press-contact part (braking member) applies the press-contact force to the collar portion 23*a* of the reel support part 23.

For example, the resistance applying mechanism may be configured such that the press-contact part provided corresponding to each reel 12 is provided to be able to swing with respect to the first support rod 43*a*, similarly to the braking member 44 in the above embodiment, and the press-contact part is caused to abut against the outer circumferential surfaces of both the flange portions 12*b* and 12*b* of the corresponding reel 12 to apply the press-contact force (rotational resistance) to the reel 12. In addition, the resistance applying mechanism may be configured such that each reel 12 is provided with a pair of press-contact parts in the form of sandwiching the reel 12, and the pair of press-contact parts sandwich both the flange portions 12*b* and 12*b* of the reel 12 and apply a gripping force to thus apply the press-contact force (rotational resistance) to the side surfaces of both the flange portions 12*b* and 12*b*.

(2) As for the resistance applying mechanism, the resistance applying mechanism 40 of the above embodiment is configured such that it includes the adjusting mechanism 50 as an adjusting part for adjusting the press-contact force applied to the corresponding reel 12 by the braking member 44 as a press-contact part, and the adjusting mechanism 50 (adjusting part) is provided for each braking member 44 (press-contact part). However, in the present invention, even if the support mechanism includes the resistance applying mechanism, the resistance applying mechanism is not limited to having the adjusting part provided for each press-contact part in this way.

For example, the resistance applying mechanism may be configured to have one adjusting part common to all the press-contact parts, and to collectively adjust the press-contact force by the one adjusting part. Specifically, in the case where the press-contact part has the same configuration as the braking member 44 of the above embodiment, the resistance applying mechanism may be configured such that all the press-contact parts are configured to be connected by a rod (connecting rod) provided in parallel with the second support rod 43*b* and (one) adjusting part is provided between the connecting rod and the second support rod 43*b*. However, in this case, the press-contact force by each press-contact part becomes a force of the same magnitude.

Further, the resistance applying mechanism may be configured not to include the adjusting part (so that the press-contact force to the reel 12 by the press-contact part cannot be adjusted). Specifically, the resistance applying mechanism may be configured such that a tension spring is provided between each press-contact part and the second support rod 43*b* and each tension spring always urges the corresponding press-contact part toward the reel support part 23 (collar portion 23*a*). Note that, in this case, the press-contact force applied to the reel 12 by each press-contact part has a predetermined magnitude corresponding to an elastic force of the tension spring.

(3) As for the resistance applying mechanism, the resistance applying mechanism 40 of the above embodiment is configured such that the braking member 44 as a press-contact part is provided for each reel 12. However, the resistance applying mechanism is not limited to the configuration where the press-contact part is provided for each reel 12, and may also be configured such that the press-contact part is provided as a single member common to all reels 12. Specifically, the resistance applying mechanism may be configured such that a (for example, rod-shaped) member provided in parallel with the bearing part of the support mechanism and to cover the presence range of all the reels 12 is used as a press-contact part and the press-contact part is caused to press-contact the outer circumferential surfaces of both the flange portions 12*b* and 12*b* to apply the press-contact force (rotational resistance) to each reel 12.

In addition, the resistance applying mechanism is not limited to being provided in the form of provided for the support mechanism 20 (the support mechanism 20 includes the resistance applying mechanism 40) like the resistance applying mechanism 40 of the above embodiment, and may be provided for the creel device 11.

For example, it is assumed that the press-contact part is composed of a single member as described above. In addition, the resistance applying mechanism may be configured such that the press-contact part is provided for the creel device 11 to be able to abut against all the reels 12 (both the flange portions 12*b* and 12*b*) of the unit body mounted to the creel device 11 and the press-contact part applies the press-contact force (rotational resistance) to each reel 12.

Alternatively, a shaft parallel to each support shaft 13 is provided for each support shaft 13 in the creel device 11, and a belt-shaped member is straddled between each reel support part 23 (collar portion 23*a*) of the unit body mounted to the creel device 1I and the shaft. Further, the resistance applying mechanism may be configured such that rotational resistance is applied to the reel 12 by sliding resistance between the belt-shaped member and the reel support part 23. Note that, in this case, the belt-shaped member becomes a press-contact part.

(4) As for the configuration of the unit body, in the above embodiment, the unit body 30 is configured such that each reel 12 is supported with respect to the bearing part 21 of the support mechanism 20 via the reel support part 23. However, as described above, in the case where the resistance applying mechanism directly applies the press-contact force (rotational resistance) to the reel 12, the unit body may be configured such that the reel 12 is directly supported with respect to the bearing part of the support mechanism without interposing the reel support part 23. Note that, in this case, a member such as a spacer is preferably provided between the adjacent reels 12 and 12.

Further, in the above embodiment, the bearing part 21 of the support mechanism 20 is a single pipe-shaped member with a length capable of supporting all the reels 12. However, in the present invention, the bearing part is not limited to being composed of such a single member, and may be formed by combining a plurality of members. For example, an annular member having a length substantially equal to the dimension in the thickness direction of the reel 12 (or, the reel support part 23 in the case where the reel 12 is supported via the reel support part 23 in the above embodiment) is configured to be connectable in a longitudinal direction thereof, and the reel 12 (or the reel support part 23) is configured to be supported by the annular member. Then, the bearing part may be formed by connecting the annular members.

(5) As for the configuration for putting the unit body of the warp supply device into a state of being mounted to the creel device, in the above embodiment, the warp supply device 10 is configured such that the bearing part 21 of the support mechanism 20 is configured as a pipe-shaped member and the pipe-shaped bearing part 21 is fitted to the support shaft 13 provided for the creel device 11, so that the unit body is mounted to the creel device 11. However, in the warp supply device of the present invention, the configuration for putting the unit body into a state of being mounted to the creel device is not limited to the configuration of the above embodiment.

For example, it is assumed that the bearing part of the support mechanism is composed of a (solid) cylindrical member. Further, the support shaft 13 is omitted on the creel device side, and instead, an attachment part configured to be able to attach and detach the cylindrical bearing part is provided. Then, the warp supply device may be configured such that the unit body is put into the state of being mounted to the creel device by attaching the bearing part to the attachment part of the creel device.

(6) As for the number of reels in the unit body, in the present invention, the support mechanism is configured to support the preset number of reels 12, and in the above embodiment, the set number is 6 (reels). However, in the present invention, the set number may be 2 or more, and may be appropriately set according to the number of warp yarns used for weaving, the configuration of the creel device, or the like. In addition, the plurality of unit bodies (support mechanisms) mounted to the creel device may not be all the same.

For example, when the number of warp yarns used for weaving is 210, 210 reels 12 are mounted to the creel device. However, in this case, when the number of support shafts in the creel device is 30, the number (set number) of reels 12 supported by the support mechanism in each unit body is 7 (seven). In addition, when the number of warp yarn s is 160 and the number of support mechanisms is 30, for example, a unit body with a set number of 5 (the number of reels 12 is 5) and a unit body with a set number of 7 (the number of reels 12 is 7) are combined, and 25 unit bodies in each of which the reels 12 are 5 and 5 unit bodies in each of which the reels 12 are 7 may be properly mounted to the creel device. In addition, it is not essential to mount the unit bodies to all the support shafts in the creel device, and the number of support shafts to be used may be appropriately set, and the number (set number) of reels 12 in each unit body may be appropriately set, taking into account the number of support shafts and the number of warp yarn s to be used.

Note that, in the case where the set number is different from the above embodiment, the support mechanism can be adapted to the configuration of the above embodiment by, for example, changing the collar member to one whose dimension in the axis line direction is different, or forming the bearing part so that a dimension in the axis line direction thereof is sized to correspond to the set number of reels 12.

The present invention is not limited to the above embodiment, and can be variously changed without departing from the gist of the present invention.

The invention claimed is:

1. A warp supply device for a loom including; reels on each of which a tape-shaped flat yarn as a warp yarn is wound in line; and a creel device including a plurality of support shafts for supporting the reels, in the creel device a same number of the reels as a number of the warp yarns to be used for weaving in the loom is mounted on the plurality of support shafts, the warp supply device comprising:

a plurality of support mechanisms provided to be attachable and detachable with respect to the creel device, the plurality of support mechanisms each configured to support a predetermined set number of the reels, the predetermined set number being two or more, wherein each of the plurality of support mechanisms includes:

a bearing part having a pipe shape and a through hole into which the support shaft is fitted and inserted, the bearing part configured to support the set number of reels such that each reel can rotate individually; and a regulating part configured to regulate positions of the reels in an axis line direction of the bearing part.

2. The warp supply device according to claim 1, wherein each of the plurality of support mechanisms includes a resistance applying mechanism configured to apply rotational resistance to each of the reels, and the resistance applying mechanism includes a press-contact part configured to be in press-contact with each of the reels and to apply a press-contact force in order to apply the rotational resistance.

3. The warp supply device according to claim 2, wherein the resistance applying mechanism is configured such that the press-contact part is provided for each of the reels and an adjusting part configured to adjust the press-contact force is provided for each press-contact part.

* * * * *